US007874033B2

(12) United States Patent
Palmer et al.

(10) Patent No.: US 7,874,033 B2
(45) Date of Patent: Jan. 25, 2011

(54) UNIVERSAL SUPPORT PILLOW

(75) Inventors: Brandon Palmer, Chicago, IL (US); Robert Hickman, Wilmette, IL (US)

(73) Assignee: United Feather & Down, Inc., Des Plaines, IL (US)

( * ) Notice: Subject to any disclaimer, the term of this patent is extended or adjusted under 35 U.S.C. 154(b) by 0 days.

(21) Appl. No.: 12/419,591

(22) Filed: Apr. 7, 2009

(65) Prior Publication Data

US 2010/0024131 A1 Feb. 4, 2010

Related U.S. Application Data

(60) Provisional application No. 61/043,852, filed on Apr. 10, 2008.

(51) Int. Cl.
*A47G 9/10* (2006.01)

(52) U.S. Cl. ..... 5/640

(58) Field of Classification Search ..... 5/636, 5/640, 644, 645, 657, 490
See application file for complete search history.

(56) References Cited

U.S. PATENT DOCUMENTS 765,519 A 7/1904 Sperry et al.
2,500,974 A 3/1950 Angert
2,805,428 A * 9/1957 Buchman ..... 5/645
2,942,281 A 6/1960 Cole
3,148,389 A * 9/1964 Lustig ..... 5/645
3,411,164 A * 11/1968 Sumergrade ..... 5/644
3,443,267 A * 5/1969 Schuckman ..... 5/645
3,521,310 A * 7/1970 Greenawalt ..... 5/636
3,543,313 A 12/1970 Schweigert et al.
3,863,283 A * 2/1975 Mohr ..... 5/639
4,606,088 A 8/1986 Michaelsen et al.
4,660,239 A * 4/1987 Thomas ..... 5/645
4,756,949 A 7/1988 Spence
4,799,275 A 1/1989 Sprague
4,959,880 A 10/1990 Tesch
5,038,432 A * 8/1991 Robillard et al. ..... 5/645
5,471,691 A * 12/1995 Ryndak ..... 5/645
5,488,746 A 2/1996 Hudson
5,528,784 A 6/1996 Painter
5,644,810 A * 7/1997 Kato ..... 5/645
5,819,347 A 10/1998 Masuda
6,026,330 A * 2/2000 Chuang ..... 607/100
6,151,733 A 11/2000 Takashima
6,317,908 B1 11/2001 Walpin
6,401,279 B1 6/2002 Vaughn
6,910,237 B2 * 6/2005 DiGirolamo ..... 5/636

(Continued)

*Primary Examiner*—Michael Trettel
(74) *Attorney, Agent, or Firm*—Cowan, Liebowitz & Latman, P.C.; Mark Montague, Esq.

(57) ABSTRACT

A universal support pillow usable by both back and side sleepers includes a first chamber having multiple filled compartments that define a first side of the pillow and a second filled chamber that defines a second side of the pillow. The multiple compartments of the first chamber are designed particularly to receive a head of a back sleeper, and the second chamber is designed to receive a head of a side sleeper. The universal support pillow, in one version, includes a closable opening that is disposed between the two chambers for receiving a pillow insert to provide user-customized thickness and firmness characteristics of the universal support pillow. Multiple types of pillow inserts having different thickness and/or firmness characteristics may be provided, wherein a user is able to select one of the pillow inserts based on the user's sleep pillow preferences.

10 Claims, 3 Drawing Sheets

U.S. PATENT DOCUMENTS 6,988,286 B2 1/2006 Schecter et al.
7,080,421 B1 * 7/2006 Delfs ..... 5/645
7,152,263 B1 * 12/2006 Delfs ..... 5/636
7,562,405 B2 * 7/2009 Brogan ..... 5/645

* cited by examiner

UNIVERSAL SUPPORT PILLOW

REFERENCE TO RELATED APPLICATION

This application claims priority to U.S. provisional patent application No. 61/043,852, filed Apr. 10, 2008, the disclosure of which is incorporated herein by reference.

FIELD OF THE INVENTION

The present invention relates to a multi-chamber support pillow and, more particularly, to a support pillow with a unique multi-chamber design for use by either side or back sleepers.

BACKGROUND OF THE INVENTION

There are many types of pillows. There are pillows for infants, for children and for adults. There are pillows that have simple designs, and there are pillows with complex designs. More complicated designs include pillows with multiple internal compartments, such as shown in U.S. Pat. Nos. 6,988,286; 6,401,279; and 5,644,810, each of which is incorporated herein by reference. Other, more complicated designs also include pillows that include some sort of insert, such as shown in U.S. Pat. Nos. 6,151,733; 5,819,347; 4,959,880; and 4,799,275. Still other types of pillow designs, some more intricate than others, are shown in U.S. Pat. Nos. 6,317,908; 5,528,784; 4,606,088; 3,543,313; 2,500,974; 2,942,281 and 705,519. Numerous other pillow designs also exist.

Moreover, there are firm pillows, soft pillows, pillows designed specifically for back sleepers, and pillows designed specifically for side sleepers. Generally, there are pillows designed for every type of preference. However, while pillows of various designs are currently available and/or have been previously proposed, there still remains the need for a pillow that can be utilized more universally, that is, be suitable for use by persons with different types of sleep preferences.

OBJECTS AND SUMMARY OF THE INVENTION

In view of the foregoing, it is an object of the present invention to provide a so-called universal support pillow that is designed to be used by different types of sleepers.

It is a particular object of the present invention to provide a universal support pillow designed for use by both side sleepers and back sleepers.

To achieve the foregoing and other objects, the universal support pillow of the present invention includes a first chamber that defines a first side of the pillow and that has two outer filled compartments and an inner filled compartment (i.e., three baffles), and a second chamber that defines a second side of the pillow. The first chamber is designed to receive a head of a back sleeper, and the second chamber is designed to receive a head of a side sleeper. A closable opening is disposed between the first and second chambers and designed to receive a pillow insert therein (to provide a desired thickness/firmness, as described in the detailed description section below).

As an aspect of the present invention, the two outer compartments/baffles are substantially firmer than the inner compartment/baffle.

As another aspect of the present invention, the inner compartment/baffle is wider than the two outer compartments/baffles.

As a further aspect of the present invention, the second chamber provides a uniform surface on its exterior for the head of the side sleeper.

As an additional aspect of the present invention, each of the compartments of the first chamber and the second chamber are filled with filling materials that may be made of cotton, polyester, feathers, down, Lyocell down or a combination thereof.

As yet a further aspect of the present invention, the pillow insert has a shell with filling material disposed therein, and the pillow insert has a certain amount of thickness and firmness.

As a feature of this aspect, the pillow insert has a filling material that is different than the filling material of the first and second chambers of the pillow.

As yet another aspect of the present invention, two pillow inserts with different thicknesses or firmness levels are provided, and one of the two pillow inserts is received within the pillow's opening.

As a feature of this aspect, the two pillow inserts have different filling materials.

In accordance with a second embodiment of the present invention, the above-summarized universal support pillow is provided, but without the closable opening between the two chambers. In addition, select aspects and features summarized above (and others described below) may be applied to this second embodiment.

Further, and in accordance with the present invention, a method of using a pillow is provided and entails providing a pillow having the above-summarized features, placing by a user who is a back sleeper the second side of the pillow down on a sleeping surface (e.g., a bed), and placing a head of the user on the first side of the pillow, the head of the user being disposed on the inner filled compartment of the first chamber of the pillow, placing by a user who is a side sleeper the first side of the pillow down on a sleeping surface, and placing a head of the user who is a side sleeper on the second side of the pillow.

As an aspect of this method embodiment, the method includes inserting, by the user, within the closeable opening a pillow insert that has a shell and a filling material disposed within the shell.

As a feature of this aspect, the method includes selecting by the user one of two different pillow inserts, and then inserting within the closeable opening the selected pillow insert. The two different pillow inserts differ by the amount of their thickness and/or firmness.

Various other objects, advantages and features of the present invention will become readily apparent to those of ordinary skill in the art, and the novel features will be particularly pointed out in the appended claims.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

As is well known, back sleepers and side sleepers require pillows of different designs to properly support the user's neck and head while sleeping. Back sleepers typically generally require pillows that suitably support the sleeper's neck while cradling the head. These types of pillows, however, are often ill-suited for side sleepers who require an even sleeping surface for proper neck alignment.

Figure 1:
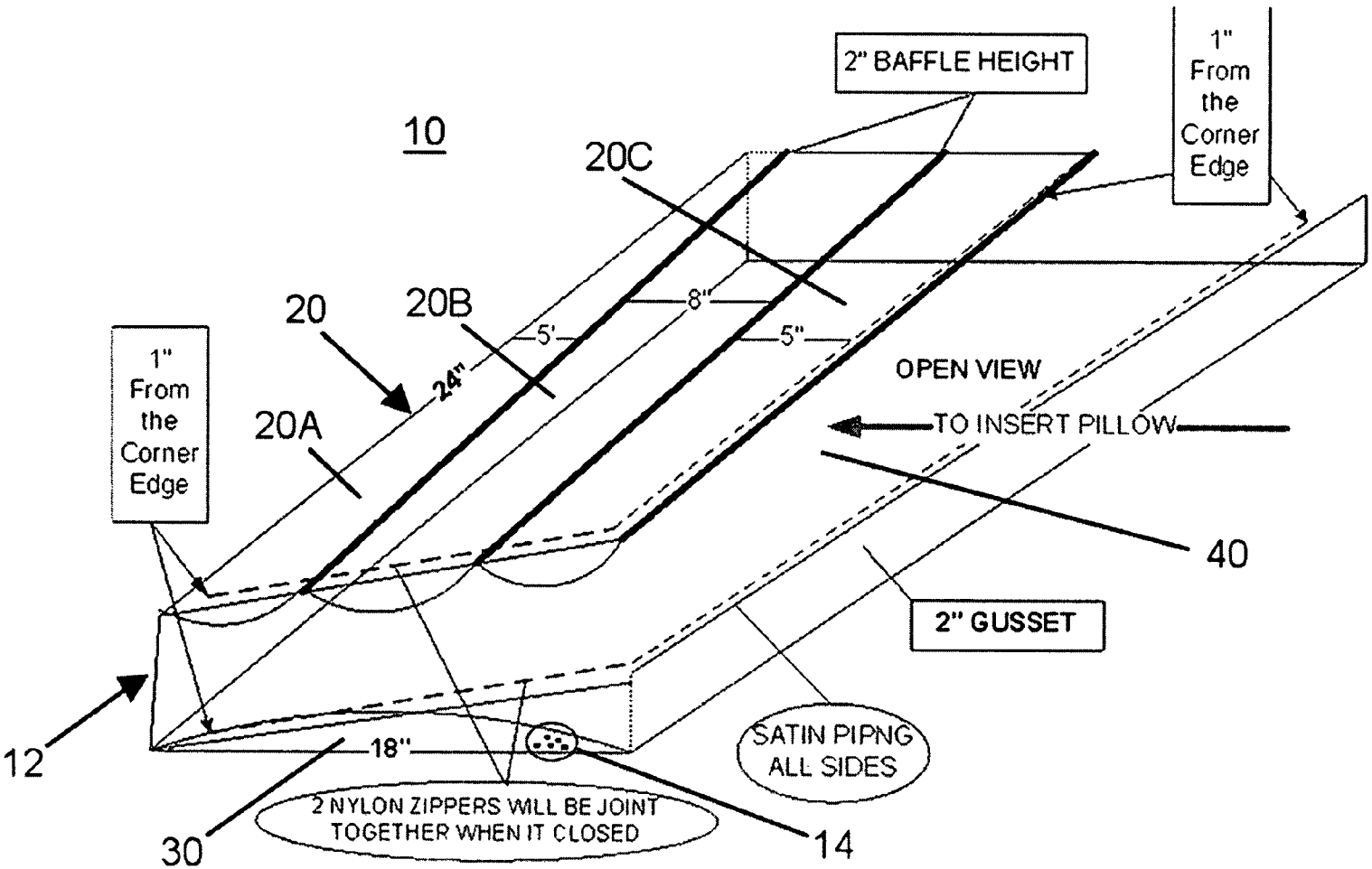
FIG. 1 is a schematic illustration of the universal support pillow of the present invention, shown in an open position.

The universal support pillow of the present invention, as described in detail below, provides a unique pillow well-suited for both back and side sleepers. In accordance with the present invention, the universal support pillow includes multiple, separate chambers with different characteristics designed for use by different types of sleepers. More particularly, and referring to FIG. 1 of the drawings, a universal support pillow 10 of the present invention includes a housing 12 that is comprised of a top chamber 20 and a bottom chamber 30. The top and bottom chambers 20 and 30 are separated from one another by an opening 40, to be described further below. In accordance with the present invention, top chamber 30 includes three baffled compartments 20A, 20B and 20C (also referred to herein as "baffles"). As shown in FIG. 1, bottom chamber 30 and each of the baffles 20A, 20B and 20C have a semi-oval shape extending along the pillow's length (e.g., from side to side) with each chamber/baffle having a substantially flat surface disposed on the pillow's exterior sides, and a respective curved surface disposed within the pillow's interior, facing the pillow's opening 40. In a variation, the interior surfaces of one or more of the bottom chamber 30 and baffles 20A, 20B and 20C are substantially flat, that is, non-curved.

Bottom chamber 30 and each of the baffles 20A, 20B and 20C is filled with suitable filling material 14. Filling material 14 may be cotton, polyester, feathers, down, a combination of feathers and down, or other known filling material. Preferably, the filling material 14 is the filling material described in U.S. Pat. No. 7,074,242, generally referred to as Lyocell Down. U.S. Pat. No. 7,074,242 is owned by the assignee of the present invention and is incorporated herein by reference.

In accordance with the present invention, baffles 20A, 20B and 20C, which collectively form the pillow's top chamber 20, have characteristics particularly well-suited for back sleepers. Specifically, the outer baffles 20A and 20C are filled with suitable filling material 14 to be relatively firm as compared to the firmness of center baffle 20B, thus providing a multi-baffle design that properly supports a user's neck (via one of the firmer baffles 20A or 20C), while, at the same time, providing a softer support (i.e., baffle 20B) that gently cradles the head during sleeping or resting. This multi-baffle design of the present invention provides for improved neck alignment which, in turn, provides for reduced snoring. Moreover, to further accommodate the user's head, the width of the center baffle 20B is slightly greater than the width of the outer baffles 20A and 20C. In the exemplary design shown in FIG. 1, baffles 20A and 20B have a width of 5 inches and center baffle has a width of 8 inches. Other dimensions may be employed.

Also in accordance with the present invention, bottom chamber 30 is a single compartment filled with filling material 14 to provide a uniform sleeping surface that is particularly well-suited for side sleepers. Given both the multi-baffle top chamber 20 and the single, uniform bottom chamber 30, the universal support pillow of the present invention is reversible and designed for use by either a side sleeper or a back sleeper.

The universal support pillow further includes opening 40, as mentioned above, disposed between the pillow's top chamber 20 and the pillow's bottom chamber 30. In accordance with the present invention, one of a multiple number of types of "pillow inserts" 42 (shown in FIG. 2) is inserted within opening 40 (also called "mid-chamber 40" herein) to thus operate as a middle or mid-chamber cushion. One type of pillow insert is a foam pillow (e.g., a visco-elastic foam). Another type of pillow insert is a fabric shell filled with polystyrene beads. A third type of pillow insert is a fabric shell filled with Lyocell down. Pillow inserts filled with other types of materials may be employed. Further, pillow inserts having different levels of firmness and/or different thicknesses and other characteristics may be employed. In any event, the end user of the universal support pillow of the present invention preferably selects or is provided with a pillow insert that, when inserted within mid-chamber 40, provides a universal support pillow having desired firmness and other characteristics.

As a particularly useful feature of the present invention, the end user may be provided with multiple types of pillow inserts and, depending on the user's desired pillow characteristics, the user selects one of those pillow inserts and inserts the selected pillow insert within mid-chamber 40. As an example, the user can select a relatively firm pillow insert for use one night, and select a relatively soft pillow insert for use another night. As a further example, the user can select a relatively thick pillow insert for use one night, and select a relatively thin pillow insert for use a different night. Thus, pillow inserts may have different firmness levels and/or different thicknesses and/or other different characteristics. If desired, the pillow may be utilized by different people at different times, wherein a pillow insert with one set of characteristics is selected for use by one person, and a different pillow insert with different characteristics is selected for use by a different person.

Figure 2:
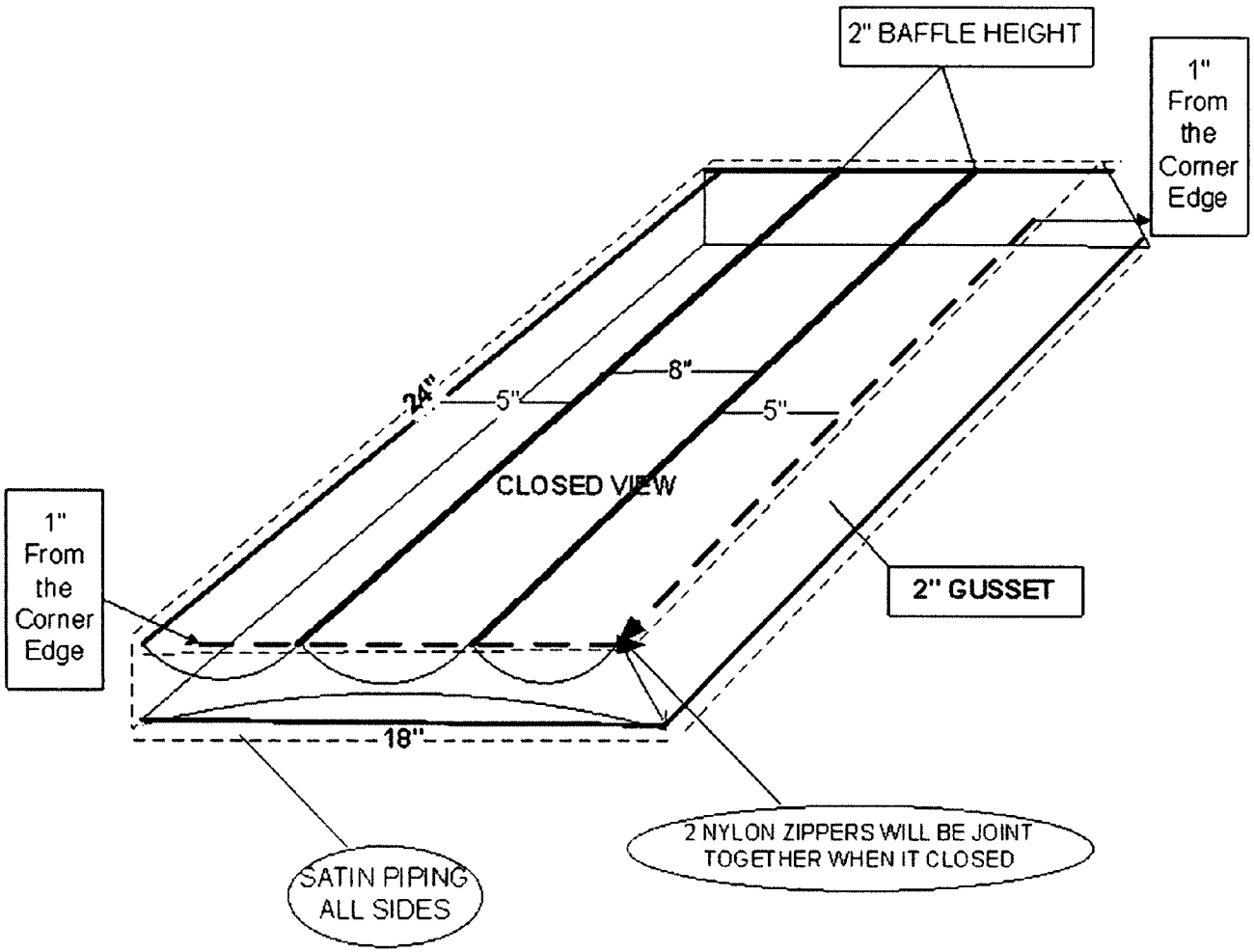
FIG. 2 is a schematic illustration of the universal support pillow of the present invention, shown in the closed position.

FIG. 2 shows the universal support pillow in its closed position. In order to close the universal support pillow, a zipper or other suitable mechanism (including, e.g., Velcro, buttons, snaps, etc.) is provided along the outer edge of opening 40. That is, the zipper or other mechanism may be placed on, adjacent to or in the vicinity of the dashed-line shown in FIG. 1. However, the size and shape of opening 40 may differ from that shown in FIG. 1.

FIGS. 1 and 2 show an exemplary universal support pillow of the present invention having a particular shape and size. Other shapes and sizes may be employed, including a non-rectangular cross-section (e.g., round, oval, semi-circular, etc.). Preferably, although not necessarily, top chamber 20, bottom chamber 30 and opening 40 have roughly the same dimensions, that is, they extend to the outer perimeter of the pillow. The universal support pillow's housing 12, that is, its outer layer, may be manufactured from any suitable material, such as cotton.

Figure 3A:
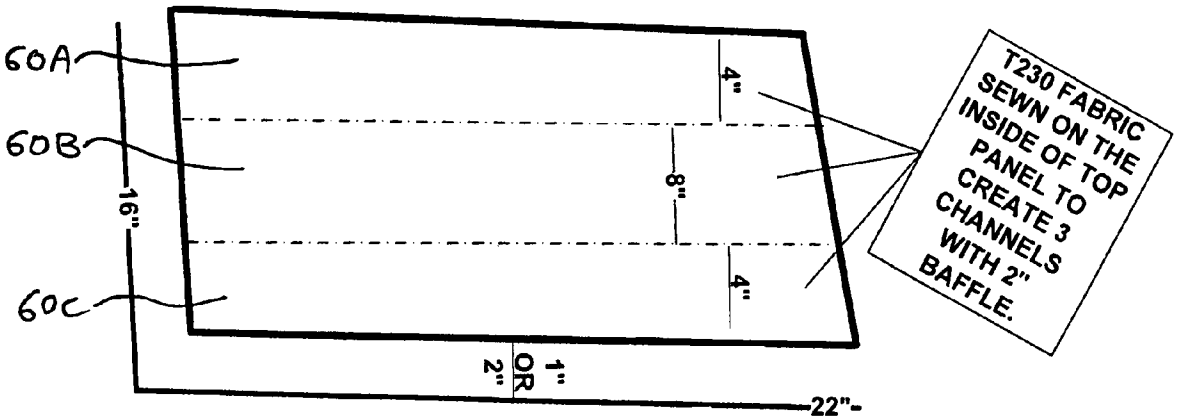
FIGS. 3A and 3B are schematic illustrations of the universal support pillow in accordance with another embodiment of the present invention.
Figure 3B:
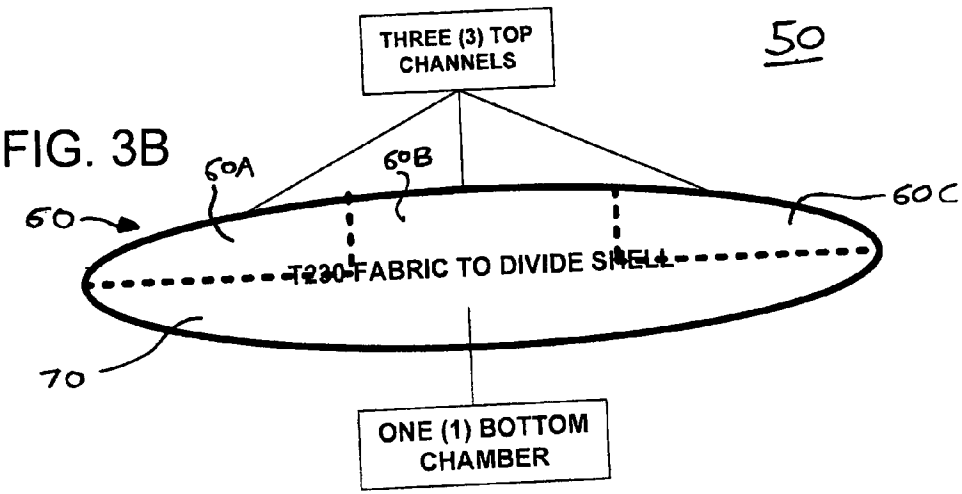

FIGS. 3A and 3B show another universal support pillow 50 in accordance with another embodiment of the present invention. FIG. 3A is a top view showing exemplary dimensions of the three baffles of the pillow, which are similar to the baffles shown in FIGS. 1 and 2. FIG. 3B is a side view of universal support pillow 50 and particularly shows a particular construction of the universal support pillow. In particular, top chamber 60, which comprises three baffles 60A, 60B and 60C, is disposed above bottom chamber 70, with the construction shown in FIG. 3B. In one version, as particularly shown in FIG. 3B, the universal support pillow lacks a mid-chamber (e.g., insert chamber 40 shown in FIG. 1) and, instead, includes only the upper chamber 60 disposed immediately above the lower chamber 70. In a variation, an insert chamber (e.g., insert chamber 40) is provided between the upper and lower chambers. In the particular embodiment shown in FIG. 3B, the pillow has edges that are knife edged wherein the edges are curved in the manner shown in FIG. 3B. Fabric is disposed within the pillow to separate the various compartments. Other features of support pillow 50 may include those described above in connection with the embodiment described in connection with FIGS. 1 and 2. Moreover, although FIG. 3A includes various dimensions, the dimensions presented are merely exemplary and thus the universal support pillow may have different dimensions.

In accordance with the present invention, and as discussed above, the universal support pillow of the present invention advantageously is well-suited for both side and back sleepers. A back sleeper places the pillow with the bottom chamber down and places one's head on the multi-baffled top chamber. The multi-baffle top chamber design provides proper support of a user's neck, gently cradles the user's head for improved neck alignment, and provides for reduced snoring, among other benefits. A side sleeper places the pillow with the top chamber down and places one's head on the single compartment bottom chamber that provides for a uniform sleeping surface best-suited for side sleepers.

The universal support pillow of the present invention also, in certain embodiments, enables a user to select any one of a number of inserts to be placed within the insert opening of the pillow in order to provide characteristics most desired by the individual user. That user or other users of the universal support pillow of the present invention may, as desired, change the insert in order to modify the pillow's characteristics, as well as use the different sides of the pillow, as desired.

The present invention has been described in the context of a number of embodiments, and a number of variations thereof. It is to be understood, however, that other expedients known to those skilled in the art or disclosed herein may be employed without departing from the spirit of the invention. Therefore, it is intended that the appended claims be interpreted as including the embodiments described herein, the alternatives mentioned above, and all equivalents thereto.

What is claimed is:

1. A pillow, comprising:

a first chamber defining a first side of the pillow and having at least two outer filled compartments and an inner filled compartment, the first chamber being adapted to receive a head of a back sleeper;

a second chamber defining a second side of the pillow and having a filling material therein, the second chamber adapted to receive a head of a side sleeper; and a closable opening disposed between the first and second chambers and adapted to receive a pillow insert therein, wherein the two outer filled compartments of the first chamber have a firmness substantially greater than a firmness of the inner filled compartment of the first chamber.

2. The pillow of claim 1, wherein the second chamber has a uniformly even surface defining an exterior surface of the second side of the pillow.

3. The pillow of claim 1, wherein the second chamber and each of the two outer filled compartments and the inner filled compartment of the first chamber has a respective filling material selected from a group consisting of cotton, polyester, feathers, down, Lyocell down or a combination thereof.

4. The pillow of claim 1, further comprising a pillow insert disposed within the opening between the first and second chambers, the pillow insert having a shell and a filling material disposed within the shell, the pillow insert having an amount of thickness and firmness.

5. A pillow of claim 1, comprising:

a first chamber defining a first side of the pillow and having at least two outer filled compartments and an inner filled compartment, the first chamber being adapted to receive a head of a back sleeper;

a second chamber defining a second side of the pillow and having a filling material therein, the second chamber adapted to receive a head of a side sleeper; and a closable opening disposed between the first and second chambers and adapted to receive a pillow insert therein, wherein the inner filled compartment of the first chamber has a width that is substantially greater than a width of each of the two outer filled compartments.

6. A pillow, comprising:

a first chamber defining a first side of the pillow and having at least two outer filled compartments and an inner filled compartment, the first chamber being adapted to receive a head of a back sleeper;

a second chamber defining a second side of the pillow and having a filling material therein, the second chamber adapted to receive a head of a side sleeper;

a closable opening disposed between the first and second chambers and adapted to receive a pillow insert therein; and a pillow insert disposed within the opening between the first and second chambers, the pillow insert having a shell and a filling material disposed within the shell, the pillow insert having an amount of thickness and firmness, wherein the second chamber and each of the two outer filled compartments and the inner filled compartment of the first chamber has a respective filling material, and the filling material of the pillow insert is of a different material than the respective filling material of the second chamber and each of the two outer filled compartments and the inner filled compartment of the first chamber.

7. A pillow, further comprising:

a first chamber defining a first side of the pillow and having at least two outer filled compartments and an inner filled compartment, the first chamber being adapted to receive a head of a back sleeper;

a second chamber defining a second side of the pillow and having a filling material therein, the second chamber adapted to receive a head of a side sleeper;

a closable opening disposed between the first and second chambers and adapted to receive a pillow insert therein; and first and second pillow inserts, each of the first and second pillow inserts having a shell and a filling material disposed within the shell, each of the first and second pillow inserts having substantially different thicknesses or amount of firmness; and each of the first and second pillow inserts being adapted to be received within the closable opening of the pillow.

8. The pillow of claim 7, wherein each of the first and second pillow inserts have respectively different filling material.

9. A method of using a pillow, comprising:

providing a pillow having a first filled chamber defining a first side of the pillow and a second chamber defining a second side of the pillow, the first chamber having at least two outer filled compartments, and an inner filled compartment having an amount of firmness substantially less than amounts of firmness of the outer filled compartment;

placing, by a user who is a back sleeper, the second side of the pillow down on a sleeping surface, and placing a head of the user on the first side of the pillow, the head of the user being disposed on the inner filled compartment of the first chamber of the pillow;

placing, by a user who is a side sleeper, the first side of the pillow down on a sleeping surface, and placing a head of the user who is a side sleeper on the second side of the pillow, wherein the provided pillow has a closable opening disposed between the first and second chambers and is adapted to receive a pillow insert within the closable opening; and the method further comprises the step of inserting, by the user, within the closeable opening a pillow insert having a shell and a filling material disposed within the shell, and wherein the inserting step comprises selecting by the user one of first and second pillow inserts; and inserting within the closeable opening the selected pillow insert; each of the first and second pillow inserts having a shell and a filling material disposed within the shell, and each of the first and second pillow inserts having substantially different thicknesses or amount of firmness.

10. The method of claim 9, wherein the second chamber has a uniformly even surface defining an exterior surface of the second side of the pillow.

* * * * *